United States Patent [19]

Bautz

[11] 4,050,412

[45] Sept. 27, 1977

[54] U.V. CURING MACHINE

[75] Inventor: Frederick H. Bautz, Hazel Crest, Ill.

[73] Assignee: Continental Can Company, Inc., New York, N.Y.

[21] Appl. No.: 539,837

[22] Filed: Jan. 9, 1975

[51] Int. Cl.[2] ..... B05C 13/02

[52] U.S. Cl. ..... 118/642; 34/4; 101/39; 432/124; 427/54

[58] Field of Search ..... 118/641, 642, 643, 66, 118/46; 34/4, 216, 104, 105, 106; 432/124; 427/54, 55; 204/159.11; 101/39, 40; 198/131, 22 R, 22 B

[56] References Cited

U.S. PATENT DOCUMENTS

| | | | |
|---|---|---|---|
| 2,577,594 | 12/1951 | Taylor | 118/643 X |
| 2,796,164 | 6/1957 | Hakogi | 101/40 X |
| 3,045,358 | 7/1962 | Breakell et al. | 34/105 X |
| 3,060,057 | 10/1962 | Johnson | 118/641 X |
| 3,310,029 | 3/1967 | Ivanoff et al. | 101/40 X |
| 3,381,391 | 5/1968 | Yunghahn | 34/105 |
| 3,496,863 | 2/1970 | Cuacho et al. | 101/40 |
| 3,667,800 | 7/1972 | Wright | 427/54 X |
| 3,767,457 | 10/1973 | Hubbard, Jr. et al. | 427/54 X |

*Primary Examiner*—John P. McIntosh

*Attorney, Agent, or Firm*—Diller, Brown, Ramik & Wight

[57] ABSTRACT

An apparatus for continuously curing can bodies coated with a photopolymerizable ink. The can bodies are placed onto spindles. The spindles are mounted onto a conveyor chain and pass the can bodies through a first U.V. lamp chamber. The U.V. lamp chamber is oriented to cure first opposed sides of the can bodies. Then the can bodies are carried on the conveyor chain in a different direction, so that as the can bodies pass through the second U.V. lamp chamber second opposed sides of the can bodies are cured. The first and second opposed can body sides are at right angles to each other. After the can body has passed through the first and second U.V. lamp chambers the entire can body exterior has been cured.

19 Claims, 5 Drawing Figures

90°
A
B
C

U.V. CURING MACHINE

This invention relates to the curing or drying of external coatings of tubular members, and more particularly to apparatus for curing coated can bodies to rapidly effect the hardening or curing of photopolymerizable inks which have been printed onto the exterior surfaces of the can bodies. A reasonably even distribution of radiation curing is effected.

In times past inks placed on the exterior surfaces of can bodies have been dried by the application of heat to the surfaces. One method of effecting such application has been to let coated can bodies sit on their ends, side by side, and be passed on a slowly moving conveyor belt through a long, heated drying tunnel. Coated can bodies have also been hung on long conveyor belts and passed through drying chambers. Patents to R. J. Younghahn, U.S. Pat. No. 3,381,391; C. J. Chebuhar, U.S. Pat. No. 2,940,581; and F. R. Scheffer, U.S. Pat. No. 2,219,166, are typical of prior drying machines and can handling methods.

With the advent of photopolymerizable inks new procedures and new opportunities for improvement of coated surfaces and curing of such coated surfaces have arisen.

A general object of this invention is to provide quick and continuous U.V. curing of can body exteriors. These exteriors have been coated with a photopolymerizable ink.

Another object of this invention is to provide substantially uniform radiant energy intensity over the exterior curved surface of the can body.

Another object of this invention is to provide a continuously operating ultra-violet oven for curing photopolymerizable inks located on the exterior of tubular bodies.

In order to obtain the complete curing of the exterior surface of a can body, in accordance with this invention it is proposed to first pass a can body through two sets of opposed U.V. lamps and then to rotate the can body 90 degrees about its axis and then pass the can body through a further set of opposed U.V. lamps.

It is also proposed, in accordance with the foregoing, to utilize the well known and simple pin type support for the can bodies. Such supports are customarily utilized in conveying can bodies and are in the form of endless conveyor chains having pins projecting therefrom at spaced intervals. It has been found, however, that in order to rotate a can body 90°, it is not sufficient to merely run the conveyor chain around 90° of a sprocket in that as the conveyor chain moves around the sprocket, the can body rotates about its pin through a limited angle. Therefore, in accordance with this invention it is also necessary to vary the angle through the conveyor chain passes about a direction changing sprocket to compensate for the rotation of the can body.

With the above and other objects in view that will hereinafter appear, the nature of the invention will be more clearly understood by reference to the following detailed description, the appended claims and the several views illustrated in the accompanying drawings:

Figures 1, 2, 3:
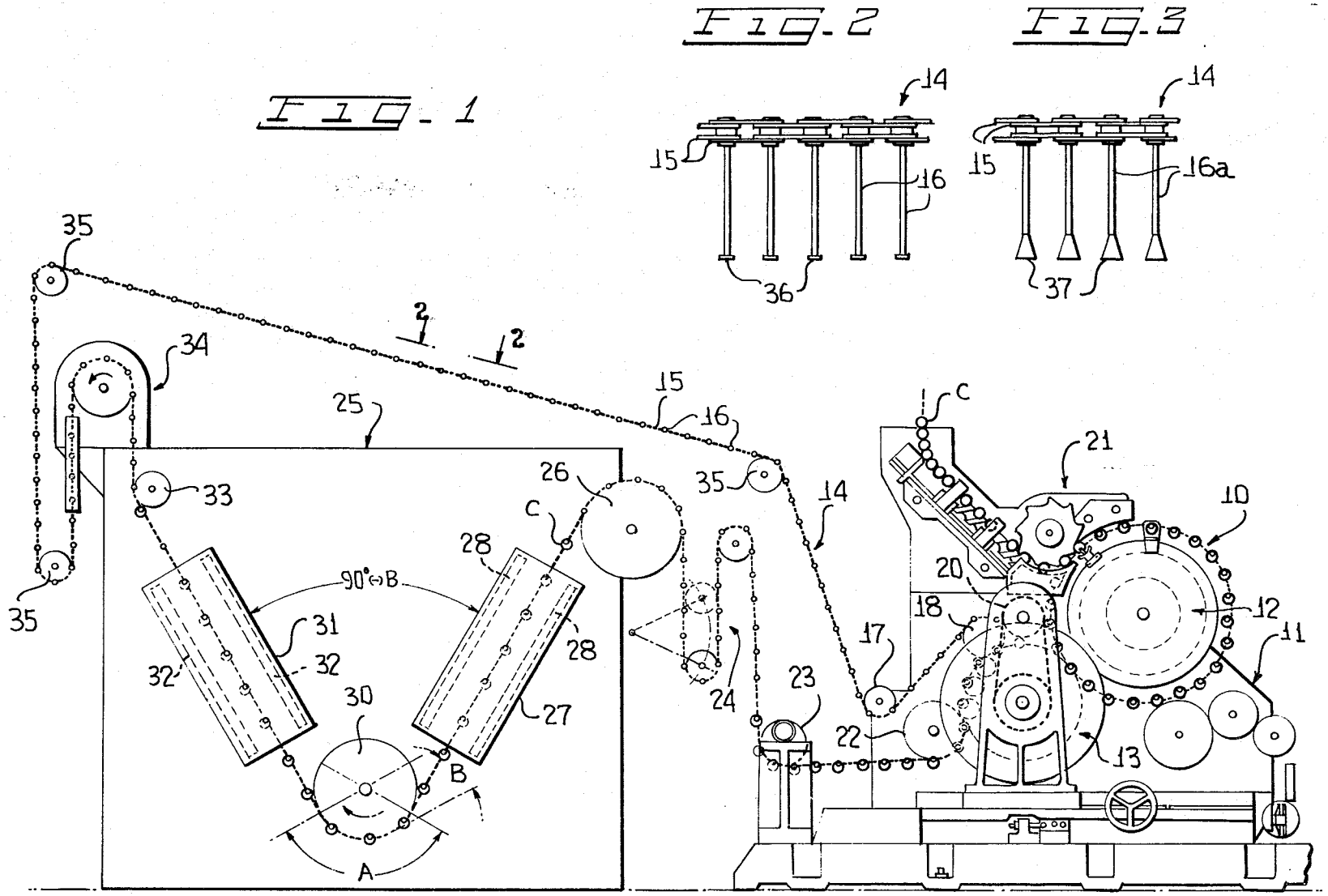
FIG. 1 is a side elevational view of a can body printing machine, a can body curing machine and an unloader.
FIG. 2 is an enlarged fragmentary generally plan view of the conveyor taken generally along the line 2—2 of FIG. 1 and shows the details of the conveyor and the pins for supporting the can bodies.
FIG. 3 is an enlarged fragmentary generally plan view similar to FIG. 2 and shows a modified form of conveyor construction.

Referring now to the drawings in detail, it will be seen that there is illustrated in FIG. 1 a conventional can body printing machine which is generally identified by the numeral 10. The printing machine includes a frame 11 which support a pair of coating or printing units, generally identified by the numerals 12 and 13. Associated with the printing units 12 and 13 for the purpose of supporting and conveying can bodies during the printing or coating operation is an endless conveyor, generally identified by the numeral 14. As will be described in more detail hereinafter, the endless conveyor 14 includes a conveyor chain 15 having carried by the links thereof at regularly spaced intervals can body supporting pins 16.

The conveyor 14, free of can bodies, enters the printing machine 10 about a sprocket 17 and then passes about sprockets 18 and 20 to a loading mechanism, generally identified by the numeral 21, wherein a can body C is placed on each of the pins 16. The can bodies C are then conveyed by the conveyor 14 first about the printing unit 12 and then about the printing unit 13, after which the conveyor 14 passes around exit sprockets 22 and 23.

It is to be understood that the construction of the printing machine 10 in of itself forms no part of this invention. However, the printing machine 10 must be of the type capable of printing onto the exterior of the can bodies a photopolymerizable ink.

After leaving the sprocket 23, the conveyor 14 passes around a tension mechanism, which is generally identified by the numeral 24 and which may be of any conventional construction. The conveyor 14 then enters into the can body curing machine, which is generally identified by the numeral 25, around a sprocket 26. The conveyor 14, with the can bodies C thereon pass downwardly through a first U.V. radiation chamber 27 which may be of any construction and which is schematically illustrated as having therein opposed U.V. lamps 28. It is to be understood that the can bodies C passing through the radiation chamber 27 will be exposed to U.V. radiation in diametrically opposed relation. The U.V. lamps emit radiation at about the range of 400 to 4000 A. It is to be understood that the U.V. lamps may be mounted within the chamber 27 in any desired manner and may be controlled in any desired manner so as to provide for the necessary curing of the can body.

It will be readily appreciated that in the passage of a can body through the radiation chamber 27, the external surface of the can body will not be completely exposed to the U.V. radiation sufficiently to effect curing entirely about the circumference thereof. It is, therefore, desirable to rotate the can bodies C90° and agains expose the can bodies to U.V. radiation.

In order to effect rotation of the can bodies C, the conveyor 14 is passed around a lower sprocket 30 prior to the passage of the can bodies C into a second U.V. radiation chamber 31. The radiation chamber 31 may be of the same construction as the radiation chamber 27 and is schematically illustrated as having on opposite sides of the path of the conveyor 14 therethrough U.V.

lamps 32. It is to be understood that the can bodies C have been rotated 90° with respect to their positions within the radiation chamber 27 when they enter the radiation chamber 31. Thus, when the can bodies C pass out of the radiation chamber 31, they will have been irradiated from four perpendicular directions which are 90° out of phase with one another.

The conveyor 14 passes around a sprocket 33 out of the can body during machine 25 into an unloader 34 which is of a conventional construction and which will unload the cured can bodies from the conveyor 14. The conveyor 14 then passes around a suitable series of sprockets 35 and then to its starting position around the sprocket 17.

It would appear that the paths of the conveyor 14 through the two radiation chambers 27 and 31 would be at right angles to each other and that the conveyor 14 would have to pass about the sprocket 30 through an angle of 90°. However, it has been found that as the conveyor moved about the sprocket 30, the pins 16 on which the can bodies are positioned change their relative positions to the horizontal and while they maintain their same relationship to the conveyor links 15, actually are rotated. The net result is that the can body carried by each pin 16 is also rotated as the pin passes around the sprocket 30.

It has been found that the amount of can body rotation is directly dependent upon the relative effective diameters of the can body and the spindle and the angle to which the can body rotates can be determined by the following formula:

$$B = 90° /(D/d - 1)$$

Where:

$B$ = angle between the normal to the first expanse and the second expanse of chain.

$D$ = diameter of the can body $d$ = diameter of the supporting pin

Inasmuch as the direction of rotation of the can body as it passes relative to the sprocket 30 is a reverse direction of rotation, it will be seen that the angle of direction change of the conveyor 14 as it passes around the sprocket 30, which angle is denoted as $A$, is determined by the following formula:

$$A = 90° + B$$

From the foregoing, it will be apparent that the angle between the paths of the conveyor 14 passing through the radiation chambers 27 and 31 will be $90° - B$.

In a typical arrangement, the ratio of can body diameter to pin diameter is about 6 to 1 with the result that the angle $B$ equals 18° and the angle $A$ equals 108°.

At this time it is pointed out that excess oscillation of the can body is avoided after the can body has passed the sprocket 30. As the can body makes the turn about the sprocket 30, it is subjected to lateral forces because it changes its direction of motion by more than 90°. The can body is also changing its downward direction of motion to an upward direction at the same time that it is making its turn about the sprocket 30. The downward force caused by the change in direction from downward to upward acts to dampen the oscillations of the can body. At can body speeds up to 1,000 cans per minute, the can bodies are hanging quietly on their spindles while they are conveyed into the entrance of the radiation chamber 31.

It is to be understood that with the arrangement shown in FIG. 1, since each can body will rotate through an angle of 180° as it passes around the sprocket 30, the direction of the can body travel through the radiation chambers 27 and 31 will be at an angle of 36° from the vertical.

Figure 5:
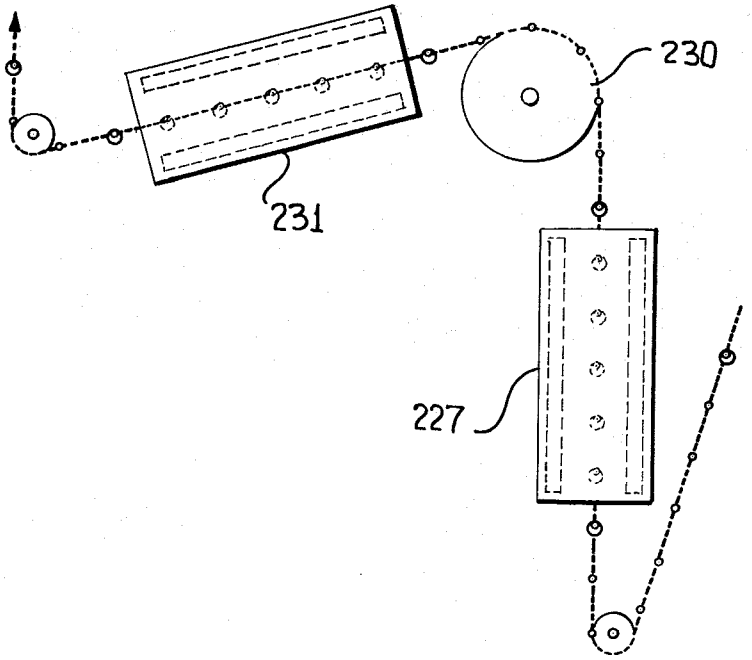
FIGS. 4 and 5 are schematic elevational views showing modified arrangements of the curing machine of FIG. 1.
Figure 4:
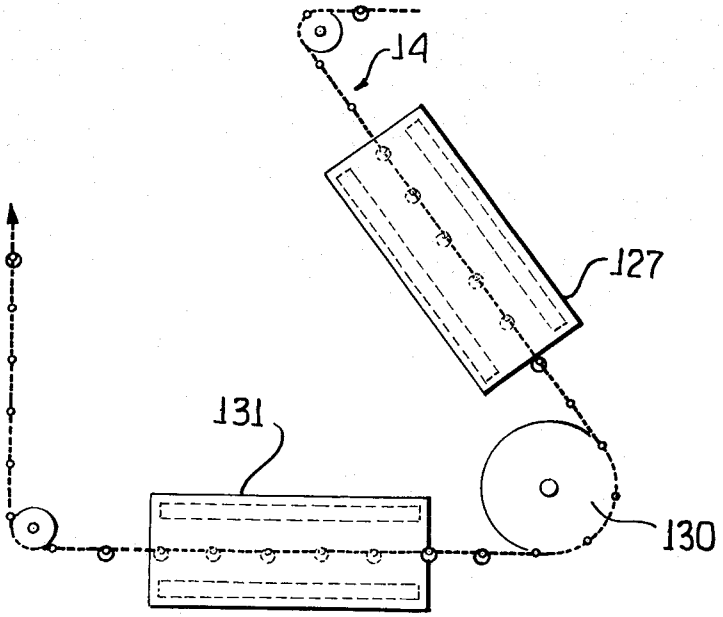

One embodiment of the invention is illustrated in FIG. 1, it is to be understood that other arrangements of the radiation chambers is feasible. With reference to FIG. 4, it will be seen that the conveyor 14 may pass down through a radiation chamber 127 at an angle, around a pulley 130 and through a horizontal radiation chamber 131. On the other hand, with reference to FIG. 5, it will be seen that the conveyor 14 may pass vertically through a radiation chamber 227, around the sprocket 230 and downwardly at a slight angle through the radiation chamber 231.

It is to be understood that the various radiation chambers 127, 131, 227 and 231 will be of a similar construction to the radiation chambers 27 and 31. It is also to be understood that the conveyor 14 will be associated with a printing machine and an unloader in the manner illustrated in FIG. 1.

Reference is now made to FIG. 2 wherein more details of the conveyor 14 are illustrated. It is to be noted that the pins 16 project from the links 15 of the conveyor 14 at the various pivots thereof, there being one link 16 at each pivot of the illustrated chain. Of course, the pins 16 may be carried by only alternate pivots.

It is to be particularly noted that the ends of the pins 16 remote from the links 15 are provided with enlarged heads 36. The purpose of these heads is that the end of a can body telescoped over a pin 16 is always lower towards the links 15 so that the can body is constantly urged towards the links 15 and is thus automatically retained on its associated pin 16.

Reference is now made to FIG. 3 wherein there is illustrated a slightly modified form of pin which is identified by the numeral **16*a*. The pin 16*a* differs from the pin 16 in that in lieu of the enlarged heads 36, the pins 16*a* are provided with conical heads 37. The conical heads 37 are adaptable to can bodies of different lengths and still function to constantly urge the can bodies towards the links 15 of the conveyor 14.**

Some of the specific advantages of this invention other than the advantages obtained in the coating of can bodies with a photopolymerizable ink and the ultra-violet curing thereof are as follows:

A compact curing machine is provided which fits into a sequence of already developed machines for performing the operations of printing, curing and unloading a can body.

The curing machine provides continuous ultra-violet curing of the can bodies coated with the photopolymerizable ink.

The curing machine utilizes the conveyor of the coating and printing machine and the customary can unloader to convey can bodies through the curing machine.

The mounting of the cans and the arrangement of the paths of the conveyor avoids wobbling of the cans to the centrifugal force as they pass from the first radiation chamber around the sprocket 30, for example, and into the second radiation chamber.

Finally, it will be readily apparent that the construction of the curing machine, particularly with the arrangement of FIG. 1, requires relatively little space.

Although only preferred arrangements of the curing machine have been specifically illustrated and described herein, it is to be understood that minor variations may be made in the machine and the utilization thereof without departing from the spirit and scope of the invention, as defined by the appended claims.

I claim:

1. A process for curing the exterior surface of a tubular body which has been coated with photopolymerizable ink, said process comprising the steps of; applying first and second ultra-violet radiant energy to first opposed areas of the exterior of a tubular body from first opposed directions, turning the tubular body circumferentially through an angle of substantially 90°, and applying third and fourth ultra-violet radiant energy to second opposed areas of the exterior of the same body from second opposed directions which second opposed areas are centered in a plane normal to a central plane of said first opposed areas whereby ultra-violet radiant energy is applied to all of the exterior surface of said tubular body with generally equal intensity, the tubular body being freely supported.

2. A process for curing a coated tubular body which has been coated with a solvent free coating and printing material; as set forth in claim 1, in which; said ultra-violet radiant energy is in the frequency range of 400 to 4,000 Angstroms.

3. A process for curing a coated tubular body as set forth in claim 1 in which said step of applying ultra-violet radiant energy to first opposed areas of said tubular body comprises the steps of: moving said tubular body in a straight path through a ultra-violet radiation chamber whereby ultra-violet radiation from first opposed directions falls onto first opposed sides of said tubular body.

4. A process for curing a coated tubular body as set forth in claim 1 wherein said body has a cylindrical exterior surface.

5. A process for curing a coated tubular body as set forth in claim 1 wherein during the application of said ultra-violet radiant energy said tubular body is continuously advancing.

6. A process for curing a coated tubular body as set forth in claim 1 wherein said tubular body is mounted on a pin type support of an endless conveyor, and the direction of movement of said conveyor is changed to effect said rotation of said tubular body.

7. A process for curing a coated tubular body as set forth in claim 6 wherein the change in direction of movement of said conveyor is an angle different from 90° by an angle to compensate for rotation of said tubular body relative to the support on which it is mounted.

8. A process for curing a can body which has been coated with a photopolymerizable ink, said process comprising the steps of; moving a coated can body laterally in a first generally straight line, applying radiant energy in the frequency range of 400 to 4,000 Angstroms a first time to the exterior surface of said can body from opposed directions and in a direction generally perpendicular to said straight line, and perpendicular to the axis of said can body to cause curing of first and second opposed side areas of said can body, altering the lateral direction of motion of said can body into a second straight line whereby the orientation of the can body as to its direction of motion in the second straight line is rotated 90° about its axis with respect to the orientation of the can body as to the direction of motion thereof when moving in the first straight line, and applying radiant energy in the frequency range of 400 to 4,000 Angstroms a second time to the exterior surface of said can body from opposed directions and in a direction generally perpendicular to said second line of motion and perpendicular to said second line of motion and perpendicular to said axis of said can body to cause curing of third and fourth side areas of said can body whereby the entire exterior surface of said can body is cured.

9. A process for curing a can body as set forth in claim 8 in which said step of moving a coated can body comprises the steps of; moving a conveyor chain in first generally straight line, allowing the coated can body to rest on a pin extending laterally from the conveyor chain whereby the coated can body is mounted on the pin in a generally horizontal position and moves along with the conveyor chain.

10. A process as set forth in claim 9 in which said step of altering the direction of motion comprises the step of; altering the first direction of motion of said conveyor chain by an angular amount equal to ninety degrees plus the quotient of 90° divided by the resultant of can body diameter divided by pin diameter and minus one.

11. A process as set forth in claim 9 in which said step of moving said coated can body further comprises the step of; moving said pin and said coated can body in a straight line downwardly sloping direction, and said step of altering the direction of motion of said pin comprises the step of; altering the direction of movement of said pin to an upwardly sloping direction with gravitational and centrifugal forces acting on said can body urging said can body against said pin to maintain the stability of said can body.

12. An ultra-violet curing machine for curing the exterior surface of can bodies coated with photopolymerizable ink, said curing machine comprising; a conveyor chain, pins mounted at spaced intervals along said conveyor chain and extending laterally from said conveyor chain whereby said pins each may receive a can body for supporting can bodies on said pins, a first expanse of conveyor chain, first and second ultra-violet lamps mounted on opposite sides of the plane of said first expanse of conveyor chain and said pins for applying radiant energy to first and second opposed side areas of can bodies, a sprocket for accommodating said conveyor chain around it and changing the direction of movement of said conveyor chain, a section of conveyor chain extending from said first expanse of conveyor and around part of said sprocket, a second expanse of said conveyor chain extending from said section of conveyor chain and in a direction relative to said first expanse of conveyor chain so that the direction of the conveyor chain is altered by an angular amount to rotate said can bodies through an angle of ninety degrees about their axes relative to their positions in said first expanse of said conveyor chain, and third and fourth ultra-violet lamps mounted on opposite sides of the plane of said second expanse of conveyor chain for receiving can bodies in their newly rotated positions and said pins for applying radiant energy to third and fourth side areas of said can bodies whereby said third and fourth ultra-violet lamps apply radiant energy to can body side areas rotated at 90° from the can body exposed to said first and second ultra-violet lamps, and all exterior portions of the curved areas of said can bodies are exposed to about the same intensity of radiant energy so that curing of the photopolymerizable ink on said exterior surface of said can bodies is effected.

13. The curing machine of claim 12 wherein angular amount of conveyor direction change is equal to about 90° plus the quotient of 90° divided by the resultant of can body diameter divided by pin diameter and minus one.

14. An ultra-violet curing oven as set forth in claim 12 in which said first expanse of conveyor chain comprises; an expanse of chain extending in a first straight line, and said second expanse of conveyor chain comprises; an expanse of chain extending in a second straight line.

15. An ultra-violet curing oven as set forth in claim 12 in which said sprocket includes; a sprocket adapted to guide said conveyor chain around a portion of its periphery and having a diameter larger than the diameter of any of said can bodies.

16. An ultra-violet curing oven as set forth in claim 12 in combination with, a continuous can body printer having an output conveyor chain for taking fully coated can bodies from said continuous can body printer and connecting to the end of the first expanse of conveyor chain whereby freshly coated can bodies are conveyed from said continuous can body printer to said first expanse of conveyor chain, and an oven unloader for removing cured can bodies from said conveyor chain after they have been cured.

17. An ultra-violet curing oven as set forth in claim 16 comprising further; a take-up means between said can body printer and said first expanse of chain conveyor whereby the chain conveyor is placed in tension.

18. An ultra-violet curing oven as set forth in claim 12 comprising further; each of said pins being horizontally disposed, and a disc mounted on the end of each pin whereby a can body mounted thereon is tilted at an angle to the horizontal pin so that the can body is urged on the pin towards the conveyor chain as its proceeds along on the conveyor chain.

19. An ultra-violet curing oven as set forth in claim 12 in which; said first expanse of conveyor chain extends in a downward direction to said sprocket, and said second expanse of conveyor chain proceeds in an upward direction whereby the swinging of said can bodies is minimized by the force of gravity as the can bodies proceed around said sprocket.

* * * * *